United States Patent [19]

Forte

[11] Patent Number: 4,571,295

[45] Date of Patent: Feb. 18, 1986

[54] AROMATIC/NONAROMATIC SEPARATIONS

[75] Inventor: Paulino Forte, Yonkers, N.Y.

[73] Assignee: Union Carbide Corporation, Danbury, Conn.

[21] Appl. No.: 494,438

[22] Filed: May 13, 1983

[51] Int. Cl.[4] ..... C10G 21/16

[52] U.S. Cl. ..... 208/334; 208/333; 208/321

[58] Field of Search ..... 208/311, 321, 322, 323, 208/324, 333, 334

[56] References Cited

U.S. PATENT DOCUMENTS

| | | | |
|---|---|---|---|
| 2,246,297 | 6/1941 | Duncan et al. | 208/324 |
| 2,261,287 | 11/1941 | Read | 208/321 X |
| 2,315,057 | 3/1943 | Holmes et al. | 208/311 |
| 2,360,801 | 10/1944 | Pierotti | 208/325 |
| 2,360,859 | 10/1944 | Evans et al. | 208/325 |
| 2,754,249 | 7/1956 | Myers et al. | 196/14.15 X |
| 2,834,820 | 5/1958 | Bloch | 208/334 |
| 2,902,428 | 9/1959 | Kimberlin, Jr. et al. | 208/333 |
| 2,910,518 | 10/1959 | Lampert et al. | 208/321 |
| 3,725,257 | 5/1973 | Cavenaghi et al. | 208/321 X |
| 4,179,362 | 12/1979 | Irani et al. | 208/321 |
| 4,260,476 | 4/1981 | Vidveira et al. | 208/333 X |

FOREIGN PATENT DOCUMENTS 865698 4/1961 United Kingdom .

OTHER PUBLICATIONS

"The Condensed Chemical Dictionary", Hawley, 1981, pp. 665, 1046.

*Primary Examiner*—John Doll
*Assistant Examiner*—Glenn A. Caldarola
*Attorney, Agent, or Firm*—Gary L. Wamer

[57] ABSTRACT

The separation of aromatic and nonaromatic containing hydrocarbon feeds is provided by use of an extraction-separation process using extraction solvents.

25 Claims, 2 Drawing Figures

AROMATIC/NONAROMATIC SEPARATIONS

FIELD OF THE INVENTION

The instant process relates to a process for the separation of aromatic and nonaromatic hydrocarbons from a mixed hydrocarbon feed, and more particularly, to the separation of aromatic and nonaromatic hydrocarbons in high yields from a mixed aromatic, naphthenic and paraffinic hydrocarbon feed. Further, said process significantly decreases the energy requirements necessary for the separation of aromatic and nonaromatic hydrocarbons. The process is particularly well adapted to the separation of aromatics from naphthenic/paraffinic hydrocarbons in a mixed hydrocarbon feed wherein the nonaromatic component comprises mineral oils and is particularly well-suited for lubricating oils (hereinafter referred to as "lube oils").

BACKGROUND

The separation of aromatic and nonaromatic hydrocarbons (generally referred to as dearomatization) from mixed hydrocarbon feeds has long been recognized as necessary and advantageous for a number of varied reasons. For example, when a BTX fraction (benzene, toluene and xylene) is the aromatic fraction it may be used as a raw material in the manufacture of petrochemicals, or as an additive for gasoline to increase its octane rating. Further, the nonaromatic fraction derived from these mixed feeds have varied uses as fuels, solvents and the like and, therefore, are also highly desirable. Such uses for the aromatic and nonaromatic fractions have resulted in the development of numerous dearomatization processes.

Of particular interest and difficulty is the separation of the complex components present in lube oils, wherein tne removal of aromatic-type hydrocarbons is necessary to improve the viscosity index, thermal and oxidation stability, and color of the lube oils. The presence of aromatic-type hydrocarbons in lube oils affects the quality of these oils due to the low viscosity index, poor thermal and oxidation stability, high carbon residue, and poor color of such aromatic-type hydrocarbons. The aromatic-type hydrocarbons present in lube oils differ significantly from the BTX fraction found in light hydrocarbon mixtures used in the production of gasoline and, as a result, present vastly different separation problems.

Various processes have been suggested for the separation of the aromatic and nonaromatic hydrocarbons of a mixed feed wherein the aromatic is a BTX fraction. Typical of these processes is a process employing an extraction column for separation of a BTX fraction wherein a glycol solvent/water solution, BTX and a reflux stream is introduced to a two step distillation column. BTX is then distilled to remove water and entrained glycol. Similarly, a process has been suggested wherein two distillation columns are employed with the BTX fraction and water being distilled in the second column. In addition, a process using two distillation columns wherein the second column is employed to distill the BTX fraction and other components, has been suggested.

The aforementioned processes have not proven satisfactory when the separation of the aromatic hydrocarbon component has been other than a BTX fraction, particularly when the process was employed for tne dearomatization of lubricating oils. Therefore, a number of processes have been proposed for the dearomatization of mixed hydrocarbon feeds containing various aromatic hydrocarbons. These processes have been directed, in large part, to the choice of the extraction solvent. For example, U.S. Pat. Nos. 2,400,732 and 2,402,799 disclose extraction/distillations employing a solvent containing primarily water as the extraction solvent. Numerous water based solvents have been suggested for the extraction of aromatic hydrocarbons from mixed hydrocarbon feeds but to date such extraction solvents have not proven to be satisfactory. These include water based extraction solvents such as: glycol/water wherein up to 50 percent glycol is added (U.S. Pat. No. 2,400,802); methanol/water (U.S. Pat. No. 3,985,644); water/non-oxygenated organic solvents (U.S. Pat. No. 2,298,791); water/amines (U.S. Pat. No. 2,401,852); and water/inorganic salts, acid or bases, or organic substances (U.S. Pat. No. 2,403,485). The problems associated with employing water-basd extraction solvents, are well known in the prior art, e.g., use of extremely high pressures.

Various processes have been suggested to help overcome the problems associated with employing water based extraction solvents. For example, U.S. Pat. No. 1,783,203 discloses the use of dry alcohols ($C_1$–$C_3$) for treating heavy petroleum oils. The problems relating to the flammability and toxicity of such alcohols are well known in the art. U.S. Pat. No. 1,908,018 discloses the use of certain ethylene glycol ethers, i.e., ethers of ethylene glycol and diethylene glycol, and their acyl derivatives in a process for refining mineral oils. The process involves separating the paraffinic and naphthenic portion by admixture of the oil feed with an ethylene glycol ether followed by cooling and agitation of the entire mixture to provide a more paraffinic upper layer and a more naphthenic lower layer. As is clear from the patent, the process is not directed to the separation of aromatic and non-aromatics. The solvent is then removed by vacuum distillation (see beginning at column 4, line 129 et seq.) The process does not employ solvent mixtures or ethylene glycol ethers with other solvents nor does the process employ glycol ethers above diethylene glycol ethers. Further the process is necessarily energy intensive owing to the use of distillation steps for the removal of the extraction solvent.

U.S. Pat. No. 2,337,732 discloses the use of ethanolamines for removing aromatics from a hydrocarbon distillate, comprising gasolines or light hydrocarbons ($C_1$–$C_5$), by an extraction-distillation process. U.S. Pat. No. 2,295,612 discloses the use of low molecular weight polyhydric alcohols for separating aromatic mixtures to obtain resin-forming compounds. U.S. Pat. No. 2,129,283 discloses the use of a beta, beta'-dichloro diethyl ether and 2–30% propylene glycol as the solvent for extracting naphthenic impurities from lubricating oils at temperatures from 120° F. to 200° F. U.S. Pat. No. 3,379,788 discloses the use of alkylene oxide adducts of phenyl glycidyl ether and U.S. Pat. No. 2,834,820 discloses the use of mixed alkylene oxide adducts of ethylene or propylene oxide as solvents in dearomatization processes.

To overcome the relatively low yields, purities and solvent recovery problems of the above processes several dearomatization processes have been suggested employing extraction and distillation. These include: solvent extraction-steam distillation processes (such as those disclosed in U.S. Pat. Nos. 3,417,033; 3,714,034;

3,779,904; 3,788,980, 3,755,154 and 3,966,589); processes employing multiple extraction zones and azeotropic distillation (e.g. U.S. Pat. No. 3,789,077); processes employing distillation and stripping columns (U.S. Pat. Nos. 4,048,062 and 4,177,137); and multiple distillation processes (e.g. U.S. Pat. No. 3,461,066). Unfortunately these processes employ costly distillation of the solvent. Furtner, high capital and energy costs are generally associated with employing such processes. Therefore, alternative processes nave been sought whereby these problems may be minimized.

U.S. Pat. No. 3,431,199 discloses a method of separating aromatic hydrocarbons from a mixed hydrocarbon feed by use of solvents comprising diethylene glycol, dipropylene glycol, sulfolane and mixtures thereof. The process is directed to the separation of light aromatics by extraction at temperatures preferably between 80° and 130° C. and employs azeotropic distillation with acetone to effect separation of the aromatic hydrocarbons. The process preferably employs solvent with 2% to 8% by weight water.

U.S. Pat. No. 3,551,327 discloses an extraction distillation process which employs a sulfolane-type solvent.

U.S. Pat. No. 3,985,644 discloses a method of separating naphtha into aromatic and paraffin-rich fractions with a methanol-water mixtures. The solvent is separated from the aromatic-rich phase by lowering the temperature of the mixture. As indicated therein, the solvent comprises methanol/water mixtures. These are highly toxic and flammable mixtures.

U.S. Pat. No. 4,086,159 discloses a method for separating aromatic hydrocarbons from mixed hydrocarbon feeds by use of an ethoxylate alkane polyol solvent in an extraction-distillation process. The ethoxylated alkane polyol solvents high boiling point provides for the recovery of high boiling aromatics such as ethylbenzene and polysubstituted benzenes. The process necessarily requires sizable quantities of energy to carry out the energy intensive distillation steps.

U.S. Pat. No. 4,179,362 discloses a method for separating aromatic-containing petroleum fractions into aromatic-rich and non-aromatic hydrocarbon streams by use of a methanol/water extraction solvent (having at least 10 volume percent water in the extraction solvent) in an extraction zone at a temperature of about 150°–450° F. The extraction employs water in the extraction step to reduce hydrocarbon solubility in the aromatic-rich extract. The extraction step is followed by further additions of water (distilled water) to the aromatic-rich extract such that the water/methanol solvent contains at least 80% water, by volume. The water and methanol must then be removed by flash distillation, an energy intensive process, or by some other process such as using super critical $C0_2$ as an extraction solvent. The hse of methanol/water solvents for treating higher distillates tends to require higher process pressures and suffers from the safety constraints associated witn methanol/water solvents, e.g., high flammability and high toxicity.

The above processes show the intense interest in developing a dearomatization process which lowers the cost of those processes heretofore used commercially. U.S. Pat. No. 3,985,644 mentions one such method for achieving this goal, i.e., by reducing the use of energy-intensive steps, e.g., distillation.

The dearomatization of lube oils is of particular interest. Dearomatized lubricating oils are, generally speaxing, naphthenic-and or paraffinic- type viscous materials having a low rate of viscosity change with change in temperature, i.e., relatively high viscosity index, a high degree of thermal and oxidation stability, low carbon-forming tendency, good color, and high flash points. Lubricating oil feedstocks are generally recovered as distillates or bottoms from the vacuum distillation of crude oils. A crude lube oil fraction contains many different chemical components, e.g., paraffins, naphthenes, aromatics, and the like. In order to obtain refined lubricating oils of relatively good quality and high viscosity index, the practice has been to remove components, such as aromatic and polyaromatic compounds, which tend to lower the viscosity index of the lube oil. The removal of these aromatic components has heretofore been carried out by processes as above-described and processes such as disclosed in U.S. Pat. Nos. 2,079,885; 2,342,205; 3,600,302; 2,773,005; 3,291,728; 3,788,980; and 3,883,420.

U.S. Pat. No. 2,079,885 discloses a process for refining hydrocarbon oils containing aromatic and non-aromatic components by counter current extraction at elevated temperatures with selective solvents such as furfural or phenol, cooling the aromatic-rich extract and oiling out the raffinate and recycling the oiled out raffinate. Unfortunately such a process results in some raffinate losses in the aromatic-rich extract.

U.S. Pat. No. 2,342,205 discloses a solvent recovery scheme wherein aliphatic and aromatic hydrocarbons are washed with water and then distilled.

U.S. Pat. No. 3,600,302 discloses a method of upgrading petroleum distillate fractions by extraction with a solvent comprising an aromatic organic compound having a 6 membered ring containing at least one polar functional group, e.g., phenol, and a lower glycol ether such as ethylene glycol monomethylether or diethylene glycol monomethyl ether. The process employs conventional distillation means to separate the solvent from the aromatic and non-aromatic phases and employs the lower glcol ether to decrease the capacity of the phenol solvent owing to the extremely high capacity of phenol at the high extraction temperatures (see col. 3, line 25 et seq).

U.S. Pat. No. 2,773,005 discloses a process wherein light lubricating oils are extracted by use of phenol and water. The phenol is recovered from a second extract fraction wherein said extract fraction contains aromatic-type hydrocarbons and phenol (extraction solvent). Thus, the process requires regeneration of the extraction solvent by means of additional separation processes in that the "second extract fraction" contains phenol (a relatively toxic compound) and aromatic-type compounds.

U.S. Pat. No. 3,291,728 discloses a process wherein a raffinate and extract fraction from an extraction process are washed with 25 percent to 50 percent, by volume, water.

U.S. Pat. No. 3,788,980 discloses a process for the recovery of aromatic hydrocarbons wherein a feedstock is contacted with a mixture of water and a solvent. The mixture containing aromatics is introduced to a distillation zone maintained at the boiling point of the mixture of aromatics with steam being introduced at the bottom of the distillation zone. Thus, a distillation zone is necessarily employed to remove the aromatic-type compounds.

U.S. Pat. No 3,883,420 discloses a process for removing aromatic hydrocarbons from an extract phase (containing aromatic and extraction solvent) by use of a mixture of steam and a lower molecular weight paraffinic hydrocarbon (solvent). The solvent is recovered by steam stripping or by extractive distillation followed by a solvent recovery column.

In copending application U.S. Ser. No. 164,039, filed June 30, 1980, commonly assigned, now abandoned a solvent extraction-solvent decantation process is disclosed wherein solvent purification with mixed hydrocarbon feed or raffinate can be employed. The instant process eliminates these solvent purification steps.

In copending application U.S. Ser. No. 267,427, filed June 4, 1981, commonly assigned, there is disclosed a process for the separation of aromatic and nonaromatic containing feedstocks by use of a unique extraction-decantation process wherein the extraction solvent as preferaoly a low molecular weight polyalkylene glycol. In U.S. Pat. No. 4,498,980 which issued on applicants' U.S. Ser. No. 465,914, filed Feb. 14, 1983, there is disclosed a process for the separation of aromatic and nonaromatic hydrocarbons with a mixed extraction solvent.

The instant process provides for an improved process by use of new extraction solvents. The process of this invention provides an extraction-separation process that is more economically advantageous, i.e., energy efficient, and overcomes problems present in some of the above-described processes.

SUMMARY OF THE INVENTION

The instant invention provides a process for the separation of aromatic and nonaromatic hydrocarbons from a mixed hydrocarbon feed in which an aromatic selective solvent(s) is employed to provide an improved process. The instant process comprises an extraction-separation process wherein aromatic and nonaroamatic hydrocarbons are separated by use of certain extraction solvents, such that the process has improved capacity, selectivity between aromatic and non-aromatic products and improved heat duty requirements for a wide range of feedstocks.

According to this invention, a mixed hydrocarbon feed (containing aromatic and nonaromatic components and referred to herein as "feed") is effectively separated with low energy consumption in a continuous solvent extraction-solvent separation process comprising contacting the hydrocaroon feed with an extraction solvent, as hereinafter defined, in an extraction zone, at an effective temperature of to provide a solvent phase and a raffinate phase.

The process is preferably carried out by (a) contacting the hydrocarbon feed with an extraction solvent, as hereinafter defined, in an extraction zone, at a temperature of at least about 150° C. to provide a solvent phase and a reffinate phase;

(b) cooling the solvent phase;

(c) introducing said cooled solvent phase to a separation zone and introducing therewith about 0.1 to about 25.0 percent by weight of an anti-solvent for said aromatic hydrocarbons in said solvent phase to provide an extract phase containing aromatic hydrocarbons and a solvent-rich phase containing extraction solvent and anti-solvent;

(d) removing anti-solvent from said solvent-rich phase and recycling said solvent-rich phase to the extraction zone of step (a); and (e) recovering the extract phase of step (c) and the raffinate of step (a).

Any entrained or dissolved solvent may be removed from the extract phase and raffinate by means of a water wash process.

DESCRIPTION OF THE INVENTION

Figure 1:
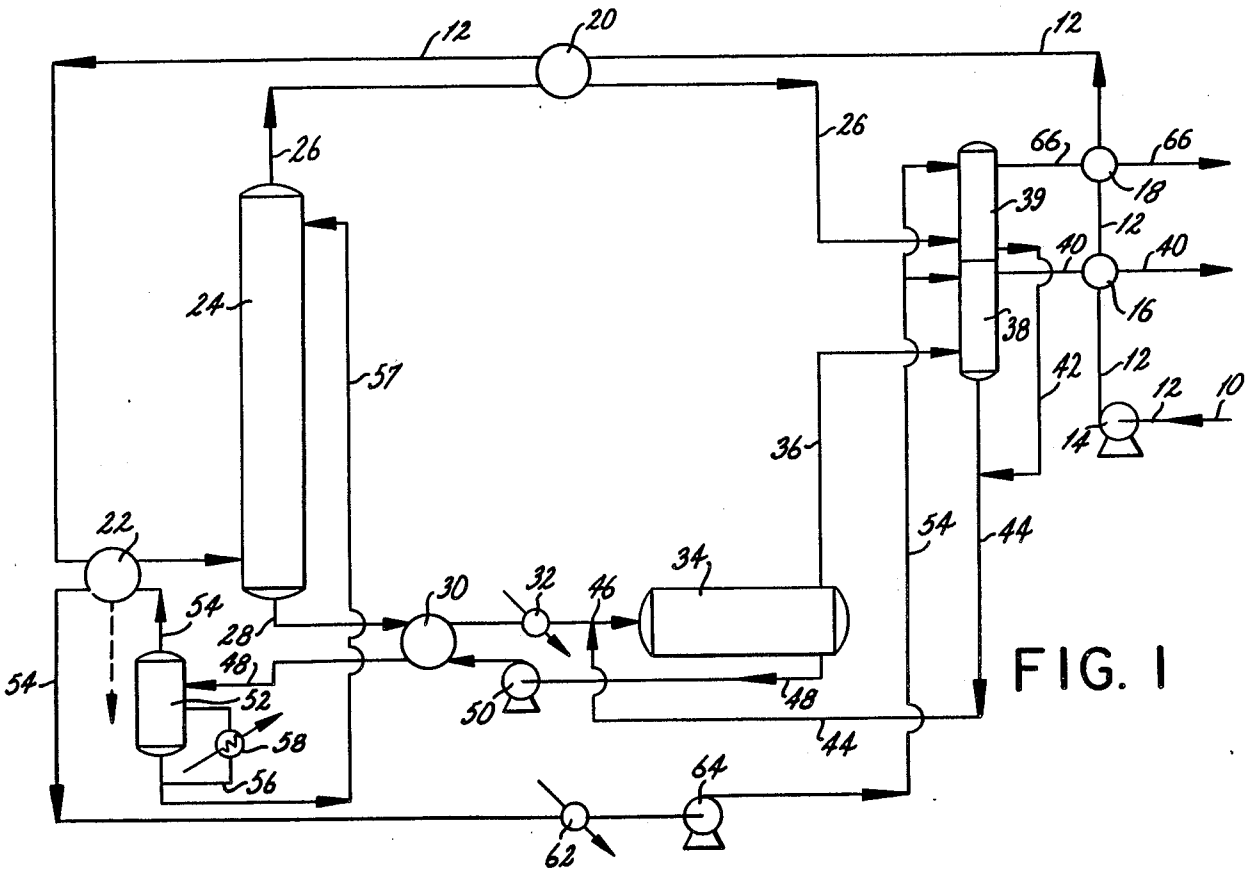
FIG. 1 is a schematic flow diagram of an illustrative embodiment of the invention.

As noted above, there has historically been and continues to be an industrial need for an energy efficient process for the separation of aromatic and nonaromatic hydrocarbons present in mixed hydrocarbon feeds. Naphthas, heating oils, light oils, cracked gasolines, dripolenes, lubricating oils (light distillates to heavy distillates) kerosene and the like, can contain up to 90 percent by weight aromatic-type hydrocarbons, e.g., BTX or polyaromatics. The separation of aromatic and nonaromatic hydrocarbons is of particular interest in the dearomatization of crude lube oils. The components wnich make up these hydrocarbon feed streams are well known in the art and they will not be extensively discussed herein except to note that the mixed hydrocarbon feed employed herein may be any petroleum of the common distillation fractions containing one or more aromatics components including: naphthas (virgin or cracked); kerosene; gasoline; heating oils; lubricating oils; (light distillates heavy distillates, bright stock and residual oils); jet fuels; and recycle oils. Preferably, the feed stream is a lube oil fraction such as a light distillates to heavy distillate, bright stock, etc., which have boiling points between about 400° F. and about 1100° F.

The aromatic hydrocarbons present in heavy hydrocarbon feeds, e.g., lubricating oils, generally include: alkylbenzenes, indanes, tetralins, indenes, naphthalenes, fluorenes, acenaphthalenes, biphenyls, phenanltrenes, anthracenes, diacenaphthalenes, pyrenes, chripenes, diaceanthrancenes, benzpyrenes and other various aromatic feed components.

The instant process provides for improved processing of feedstocks containing aromatic and nonaromatic components. The use of the hereinafter described "extraction solvent" in the instant extraction separation process provides several significant advantages. Firstly, the use of lower solvent to feedstock ratios (lower solvent recirculation rates) which reduces the size of the equipment required for the process and, therefore, the required capital investment. Secondly, the use of decreased amounts of water are employed for solvent separation and as a result the amount of water employed to wash the raffinate and extract in order to remove solvent entrained and in solution, as hereinafter described with reference to the drawings. This decrease in the amount of water required in the solvent separation step decreases the net energy requirements of the process. Thirdly, energy consumption of the process is dependent on the total amount of feedstock treated and not on the solvent to feedstock ratio employed. This advantage makes the instant process capable of treating different feedstocks, e.g., light paraffin distillate vs. bright stock, without significantly increasing the energy requirements of the process. This results in savings, in terms of the energy consumption of the process, of up to 50 percent or more, based on the energy required in furfural or similar processes presently employed in the art. Fourthly, the process provides a greater degree of operability to the process by use of varying amounts of the component solvents based on the feedstock being treated. Fifthly, in general, the process permits the use of relatively low extraction temperatures, and, thus, improves the thermal stability of the extraction solvent.

The term "water-miscible" describes those solvents and cosolvents which are completely miscible with water over a wide range of temperatures and which have a high partial miscibility with water at room temperature, since the latter are usually completely miscible at process temperatures.

The term "extraction" solvent herein denominates an extraction solvent selected from the group consisting of specific "glycol ethers", as hereinafter defined, and mixtures thereof and hexylene glycol, and to extraction solvents employing glycol ethers as in a major amount as solvents.

The term "glycol ether" as employed herein refers to a glycol ether of the formula $$R_4O—[CHR_5—(CHR_6—)—_xO]_y—R_7$$

wherein $R_4$, $R_5$, $R_6$ and $R_7$ may be hydrogen alkyl, aryl, aralkyl, alkylaryl and mixtures thereof with the proviso that $R_4$ or $R_7$ are not both hydrogen. The value of x is an integer from 2 to 5, preferably 3 or 5 and y may be an integer from, 2 to 5 and is preferably from 3 to 5, and most preferably 3 or 4. $R_4$, $R_5$, $R_6$ and $R_7$ are preferably selected from the group consisting of hydrogen and alkyl having 1 to about 10 carbons with the proviso that $R_4$ and $R_7$ may not both be hydrogen.

An anti-solvent may be employed in the solvent separation step of the instant process and such may be most any compound that tends to decrease the solubility of the aromatic hydrocarbon in the extraction solvent. Water is the preferred anti-solvent since the energy requirements of the process are significantly minimized by removing the water by distillation thereby generating steam for use in this or other processes. Further, the use of water as an antisolvent in the extraction step has been observed to provide added process versatility by correlating the selected feed with the extraction solvent and the effective amount of anti-solvent present in the extraction zone. Other suitable anti-solvents are believed to include ethylene glycol, glycerine, low molecular weight alcohols and the like. The use of low molecular weight alcohols, even at the low concentration of antisolvent employed, is not generally preferred owing to the art recognized problems associated with the use of alcohols. The effective concentration of the anti-solvent as determined in the separation zone is that amount which effectively decreases the solubility of the aromatic hydrocarbon in the extraction solvent as determined by the amount of aromatic hydrocarbon in the extraction solvent leaving the separation zone. The concentration of aromatic hydrocarbons in the extraction solvent leaving the separation zone is preferably less than 5 percent by weight, based on the weight of the extraction solvent and is preferably less than 3 percent by weight. The anti-solvent employed in the instant process promotes the formation of two phases to a degree greater than that obtainable by simple cooling of the phase obtained by extraction such that an aromatic-rich extract phase and a solvent-rich phase are formed. Generally the concentration of the anti-solvent present in the separation zone is in the range of from about 0.5 to 25.0 percent by weight or higher, based on the total weight of the aromatic-rich solvent phase, with the range from about 0.5 to about 15.0 percent being preferred and the range from about 3.0 to about 10.0 being most preferred. Some portion of the anti-solvent present in the separation zone may be provided by anti-solvent which may be present in the aromatic-rich solvent phase obtained from the extraction zone as a result of amounts present due to the recycle of the extraction solvent and antisolvent. As hereinbefore noted, the presence of up to about 10 percent by weight (based on the total weight of the recycled extraction solvent) may be advantageous in correlating the extraction solvent to changes in the feedstock. The actual concentration of the anti-solvent in the decantation zone may be higher than 25.0 percent by weight depending on the selection of the hydrocarbon feed, aromatics present in the feed, the extraction solvent employed and the like. The aforementioned concentrations designate the total anti-solvent, e.g. water, present in the separation zone irrespective of its source. Anti-solvent is preferably added to the aromatic-rich solvent phase prior to the separation zone so as to provide for improved separation therein.

Generally, to accomplish the extraction, the ratio of the extraction solvent to hydrocarbon feed in the extractor zone is in the range from about 2 to about 20 parts by volume of solvent to one part by volume of feed, the ratio from about 2 to 1 to about 15 to 1 being preferred and the ratio from about 4 to 1 to about 10 to 1 being the most preferred. The broad range for the ratio of the solvent to hydrocarbon may be expanded upon depending on the solvent, the weight percent of anti-solvent in the extraction solvent and the like. The optimum solvent to feed ratio also depends upon whether high recovery (yield) or high purity (quality) is desired, although the instant process will generally result in both high recovery and high purity.

It has been observed that by using the instant extraction solvents that a process is provided that has a high selectivity and capacity for aromatic hydrocarbons and, further, provides a process wherein the heat duty for the process (the energy consumption of the process) is proportional to the rate at which the feed is introduced and not strictly dependent on the ratio of the solvent to feed. Thus, the instant process provides for the use of similar energy requirements for vastly different feedstocks. This important feature is not found in processes wherein fufural, N-methyl-2-pyrrolidone are phenol is employed as the extraction solvent.

The instant process is further characterized in that the pressure at the top of the extraction zone is typically less than about 150 psig and often less than about 100 psig. This is highly advantageous in terms of ease of operation and the capital expenditure required for carrying out the separation process. The actual pressures in the extraction zone may be higher or lower depending on the particular hydrocarbon feed treated, the extraction solvent employed, the selected antisolvent and its concentration, and the selected temperature at which the extraction is carried out. The pressure employed in the separation zone generally is simply that pressure which is required to cause the aromatic-rich solvent phase to pass through the separation zone although higher pressures may be employed if desired. Generally a small pressure drop (pressure gradient) is observed across the separation zone.

The effective temperature of the extraction zone is generally at least about 100° C. and is preferably in the range of from about 150° C. to about 275° C., more preferably in the range of from about 170° C. to about 250° C. and most preferably from about 200° C. to about 240° C. The effective temperature of the extraction zone can vary with the selected feed. The temperature in the extraction zone is not constant throughout and there will generally be a temperature gradient up to about 30° C. or more as between the temperature of the extraction solvent introduced to the extraction zone and the temperature of the phase leaving the extraction zone. The separation zone is generally maintained at a temperature in the range of from about 50° C. to about 200° C. below the temperature of the extraction zone such that the temperature is preferably in the range of from about 25° C. to about 150° C., more preferably about 25° C. to about 100° C. and most preferably from about 25° C. to about 70° C. The temperature employed in the separation zone depends, in part, upon solubility of the aromatic hydrocarbon in the extraction solvent, the amount of anti-solvent present in the separation zone and the viscosity of the extraction solvent at the temperature of the separation zone.

The apparatus employed in the instant process in the extraction zone, separation zone and otherwise are of conventional design. For example, an extraction column of the multistage reciprocating type containing a plurality of perforated plates centrally mounted on a vertical shaft driven by a motor in an oscillatory manner can be used as may columns containing pumps with settling zones or sieve trays with upcomers or downcomers, (Counter-current flow is generally utilized in the extraction column.) The separation in the separation zone can be conducted in a tank with no internal elements but preferably the tank contains coalescing elements or baffles to aid in the separation. The preferred separation zone comprises a coalescer with a porous media having a depth-type coalescing element (fibrous bed coalescer element). It is understood that the "separation zone" is a zone wherein phase separation is facilitated and wherein anti-solvent is present. As noted hereinabove, the anti-solvent is preferably added prior to the separation zone after the solvent phase exits the extraction zone and is cooled.

Heat exchangers, reservoirs, and solvent regenerators, if necessary, are also of conventional design as well as are the various extractors and decanters used in the various embodiments hereinafter described. The extractors employed are preferably multi-stage counter-current extractors, but can be any of the well-known types, as aforementioned.

The instant process generally provides for an overall recovery of the aromatic hydrocarbon of from about 70 to about 95 percent or better based upon the weight of aromatic in the original hydrocarbon feed and usually provides for similar recoveries for the nonaromatic hydrocarbons.

EXPERIMENTAL PROCEDURE

Figure 2:
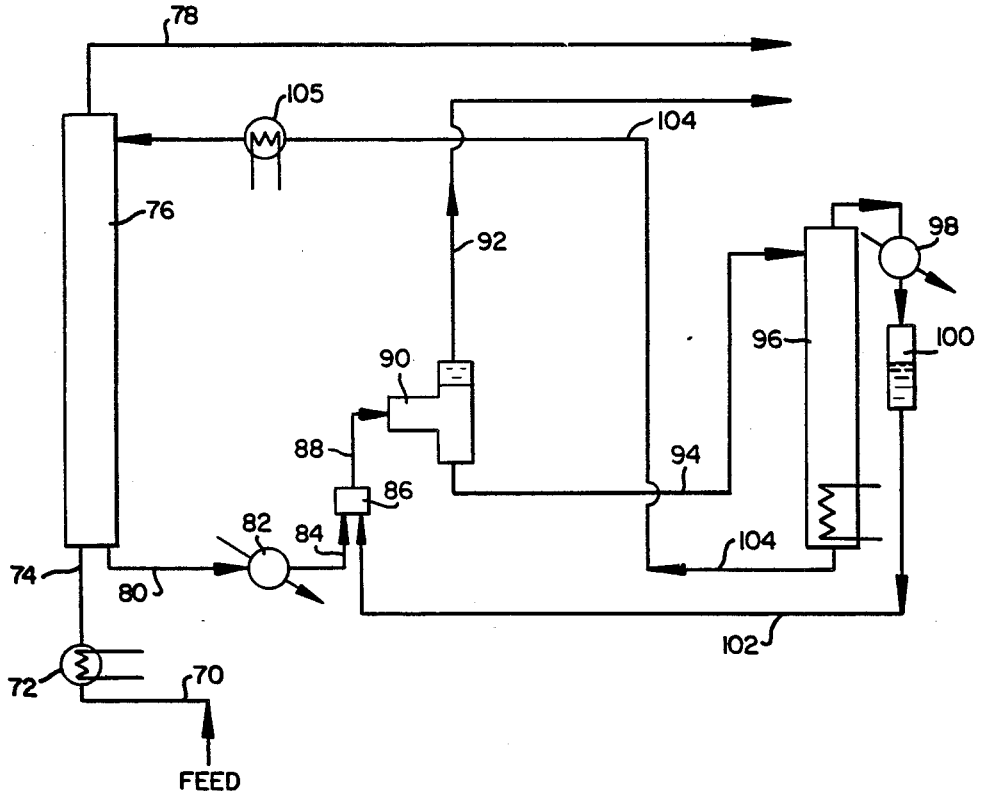
FIG. 2 is a schematic flow diagram of the process as employed in the examples.

In carrying out an aromatic/non-aromatic separation a suitable procedure would employ the scheme of FIG. 2 and would employ as the extraction column a Karr (TM) reciprocating plate extraction column made of 2 inch (internal diameter) glass pipe, having an internal volume of about five liters and having reciprocating plates spaced two inches apart. All internal metal parts are generally No. 316 stainless steel except the reciprocating plates which are typically Teflon (TM). The separation zone is generally a tank with or witnout baffles or a glass separator (e.g., Model No. LS-60P from Selas Corporation of America) having a depth-type coalescing element. A fibrous bed coalescing element is the preferred coalescing element. The tubing is generally No. 316 stainless steel tubing having a $\frac{3}{8}$ inch outside diameter with a 0.035 inch wall thickness. A water stripper comprising a 4 inch (inside diameter) glass distillation column is packed with stainless steel protruded metal packing (0.24 inch×0.24 inch).

The oil content of the various phases may be determined by a gas chromatograph (Hewlett-Packard Model 5750) using a 2 millimeter by 6 foot glass column packed with a 3 percent OV-101 on Chromosorb W (TM) equipped with a flame ionization dectector. The water content of the various phases may be determined using a Karl-Fisher automatic titrator (Model 392) and an automatic burette (Fisher Model 395).

The viscosity index (referred to as the "VI") for the hydrocarbon feed and products may be determined by ASTM Method D2270-75. The Viscosity Index for an oil product is a measure of the purity of that oil product with a higher Viscosity Index indicating that the oil product has a higher purity (i.e., contains less aromatics). The viscosity index of the products may be determined by measurement of the refractive index of the hydrocarbon feed or product at 70° C. after having correlated the viscosity index as determined by ASTM D2270-75 to the refractive index at 70° C.

Temperatures and pressures are measured by conventional detection means.

FIGS. 1 and 2 depict two schemes which may be employed to carry out the aromatic/non-aromatic separation process of the instant invention.

Referring to FIG. 1:

The mixed hydrocarbon feed is introduced at 10 through line 12 to pump 14. The feed passes through line 12 and heat exchanger 16, 18 and 20 where it is heat exchanged with aromatic-rich extract and raffinate, respectively to preheat the feed. The feed is then heat exchanged in heat exchanger 22 with steam in line 54 (steam formed by distilling the anti-solvent, i.e., water, from the solvent phase when water is the anti-solvent) prior to introduction to extraction column (zone) 24. A extraction solvent (hereinafter "extraction solvent"), preferably having a temperature in the range of from about 150° C. to about 275° C., most preferably about 200° C. to about 240° C. is introduced near the top of extraction column 24 via line 57 and percolates down column 24 removing aromatics from the hydrocarbon feed forming raffinate and an aromatic-rich solvent phase. Tne raffinate, containing primarily non-aromatics, exits the top of the column 24 via line 26 and in heat exchanger 20 preheats the mixed hydrocarbon feed and is cooled in turn by heat exchange with the incoming mixed hydrocarbon feed. The raffinate then passes to extractor 39 where it is contacted with water (when water is the selected anti-solvent the extraction water is preferably water removed from the extraction solvent) to recover extraction solvent present in the raffinate so as to form a water phase and a final raffinate product. Some feedstocks (e.g. bright stock and heavy distillates) may result in a raffinate with entrained solvent. The major portion of this solvent should preferably be removed prior to the aforementioned step. A second water extraction takes place in extractor 38 wherein the aromatic-ricn extract from separation zone 34, discussed hereinafter, forms a water-phase (containing extraction solvent) and a final aromatic product. The water-phases from extractors 38 and 39 contain primarily water and small amounts of the extraction solvent that was dissolved or entrained in the aromatic-rich extract and raffinate. The combined water-phases are recycled to separation tank (zone) 34 via line 44, as needed, if water is the selected anti-solvent.

It should be pointed out that the terms "phase" and "product" are named after their main components, which is present in the phase in an amount of at least 50% by weight and in most cases in an amount of 80% by weight or higher. The aromatic-rich solvent phase, containing primarily extraction solvent and aromatic hydrocarbons, leaves the bottom of extraction column 24 via line 28 and heat exchanger 30 where it is cooled with extraction solvent in line 48. Tne aromatic-rich solvent phase is further cooled to promote two phase formation, if necessary, in cooler 32. Recycled extraction solvent and anti-solvent, when water is the selected anti-solvent, are introduced via line 44 to separation tank (zone) 34. Thus, the solvent contained in line 44 is returned to the process. The anti-solvent is preferably added to the aromatic-rich solvent phase prior to separation zone 34 to further promote phase formation, e.g. at 46 of the drawing, in the separation zone although the anti-solvent may be added directly to separation zone 34 if desired. The anti-solvent in the extraction solvent/anti-solvent mixture of line 44 reduces the solubility of the aromatic hydrocarbon in the extraction solvent to a degree not obtainable by simple cooling of the aromatic-rich solvent phase. The anti-solvent is typically present in separation zone 34 at a concentration of between about 0.5% and about 25.0% by weight, based on the weight of aromatics and solvent in separation zone 34, preferably from about 0.5% to 15.0% by weight and most preferably from about 3.0% to about 10.0% by weight. The presence of the anti-solvent in the separation zone decreases the solubility of the aromatic in the extraction solvent such that preferably less than about 3% weight percent aromatic and often less than about 2% weight percent, leaves decantation tank 34 via line 48.

The aromatic-rich extract phase of separation zone 34 exits via line 36 to water-extraction column 38 where it is contacted with water (preferably water derived from the removal of water from the extraction solvent/anti-solvent mixture) from the solvent phase of separation zone 34. This extraction with water removes extrained and dissolved solvent from the aromatic-rich extract phase.

The solvent phase of separation zone 34 passes via line 48 througn pump 50 to heat exchanger 30 wherein it heat exchanges with hot aromatic-rich solvent of line 28 prior to introduction to distillation column (zone) 52. If further heating of the solvent in line 48 is desired an additional heat-exchanger (not shown) may be provided to allow heat exchange between the solvent phase of line 48 and the solvent of line 57. Such additional heat-exchanger would also serve to cool the solvent in line 57, if necessary. The use of a distillation zone in the instant embodiment is not intended to be limiting since any means for decreasing the concentrarion of the anti-solvent in the extraction solvent may be employed. The use of a distillation zone is preferred when the anti-solvent is water since the steam generated therein may be advantageously and economically employed in this and/or other processes (not shown).

When water is the selected anti-solvent the solvent phase in line 48 is introduced to distillation zone 52 wherein water is distilled, preferably under pressure, and removed as steam via line 54. Steam in line 54 is heat exchanged at 22 with the mixed hydrocarbon feed after which the steam may be condensed by cooler 62, and the water condensate may be employed in extractors 38 and 39. Alternatively, the steam leaving heat exchanger 22 may be advantageously employed in this or other processes (not shown). Heat exchange at 22 may result in the condensation of small amounts of extraction solvent present in the steam (indicated at 22 by a dashed arrow). This solvent can be recycled to extraction column 24 by combining the solvent with the solvent from line 57 from distillation zone 52 (not shown). By such use of the process steam the heat input to the process may be, in part, heat supplied by steam heater 22 in conjunction with distillation zone 52.

As above discussed alternative schemes may be substituted for that above-described for the removal of the anti-solvent, depending on the selection of the anti-solvent. The above described scheme is particularly advantageous in terms of the reduction in energy required to carry out the instant process. For example, the above-described extraction-separation process results in a reduction in energy requirements for the dearomatization, as compared to conventional dearomatization processes, by as much as 50 percent to about 80 percent depending on the feed being subjected to dearomatization by use of the process hereunder.

The total anti-solvent, e.g. water in the system can be easily determined because the amount of water introduced at 46 to separation zone 34 can be controlled. Allowances must be made for water losses through leakage and upsets so as to maintain the amount of anti-solvent present in separation zone 34 at from about 0.5 to about 25.0 percent by weight and most preferably from about 5.0 to about 10.0 percent.

Another scheme for carrying out the instant process is depicted in FIG. 2. In this process scheme certain features discussed in reference to the process depicted in FIG. 1 were not employed. The mixed hydrocarbon feed is introduced in line 70 from an external feed source (not shown) and was heated in heater 72. The heated feed then passed through line 74 to extraction column (zone) 76. Aromatic selective solvent was introduced near the top of extraction column 76 via line 104 after heating in heater 105. The extraction solvent percolates the down column 76 removing aromatics from the hydrocarbon feed, forming raffinate and an aromatic rich solvent phase (hereinafter designated RS as the phase for rich-solvent). The raffinate containing primarily non-aromatics, exits the top of column 76 via line 78 and is collected as raffinate product. This raffinate product is cooled and any extraction solvent separated by decantation. The raffinate product is then washed with water (not shown). The viscosity index of this raffinate product is then measured by measuring the refractive index of the raffinate at 70° C., as hereinbefore discussed.

The RS phase in line 80, containing primarily extraction solvent and aromatic hydrocarbons, is cooled in heat exchanger 82 (generally comprising one or more cold water heat exchanger in series) and is introduced to mixer 86. Mixer 86 is employed to feed and mix the contents of lines 84 and 102 to line 88 for introduction to separation zone 90. Mixer 86 herein comprises a mechanical magnetic stirrer. Anti-solvent (in the instant examples water is the anti-solvent) is introduced via line 102 and the RS phase and the anti-solvent are mixed and introduced to separation zone 90. In this embodiment the separation zone may be a tank or a fibrous bed coalescer such as available from Sealas Corporation (Model No. LS-60P). In addition, it may be desirable to employ a filter in line 88 (not shown), e.g., an in line cotton filter, to remove solids that may be present in the phase in line 88. This is especially desirable when a fibrous bed coalescer is employed and such a filter was employed herein when a fibrous bed coalescer was employed. The anti-solvent may be added to separation zone 90 directly if desired, i.e., line 102 may alternatively be introduced to separation zone 90 although such is not preferred. As aforementioned, the cooling by means of heat exchanger 82 and the addition of the anti-solvent reduces the solubility of the aromatic hydrocarbon in the extraction solvent such that an aromatic-rich extract phase is formed and a solvent phase is formed containing as the major component the extraction solvent and anti-solvent (hereinafter referred to as the wet LS (lean solvent)phase.

The aromatic-rich extract phase of separator zone 90 leaves decantation zone 90 through line 92.

The wet LS phase of separation zone 90 leaves the separation zone via line 94 and is introduced to water stripper 96 wherein some portion of the water (the selected anti-solvent herein) in the wet LS phase may be removed by condensing in water condenser 98 and introduced to water accumulator 100. Water, employed as the anti-solvent, is introduced via line 102, as required to provide the desired concentration of water (anti-solvent) in separation zone 90. Solvent exits water stripper 96 (hereinafter referred to as the dry LS (lean solvent) phase via line 104 and is introduced to extraction zone 76 after heating in heater 105 as hereinbefore discussed. The dry LS phase contains some amount of water and may contain up to about 10 percent by weight water or higher. Typically the dry LS contains less than about 10 percent by weight water. As hereinbefore noted, the amount of water present in the dry LS may be advantageously adjusted to provide enhanced performance of the extraction solvent with different feedstocks. This adjustment of the amount of antisolvent in the LS phase may be made by adjustment of the temperature and pressure in the antisolvent removal zone. Accordingly, the capacity and selectivity of the extraction solvent can be correlated to the specific feedstock being treated by the correlation of the feedstock, extraction solvent and the amount of water present in the recycled extraction solvent (dry LS). As hereinbefore discussed, a small amount of oil may also be present in the dry LS phase.

The following examples are provided to illustrate the invention and are not to be construed as limiting such in any way.

EXAMPLES

The process depicted in FIG. 2 is carried out using as the solvent one of the following solvents: methoxy triglycol, methoxytetraglycol ethoxy tetraglycol, ethoxy triglycol or butoxy triglycol. The temperature of the Lean Solvent introduced in the extraction zone is about 235° C.±5° C. and the temperature in the separation zone is 65° C.±5° C. The feedstock is bright stock having a refractive index at 70° C. of 1.4820 (viscosity index of 91).

The separation of the aromatic and the non-aromatic is observed. The extraction solvent has the advantage of being particularly well suited in processes which employ a water wash process step(s) for solvent recovery, thus eliminating the need for expensive distillation processes for solvent recovery.

What is claimed is:

1. The process for the dearomatization of a mixed hydrocarbon feed which comprises the following steps:

(a) contacting said feed in an extraction zone at a temperature of at least about 150° C. with at least one extraction solvent consisting essentially of an extraction solvent selected from the group consisting of hexylene glycol and glycol ethers of the formula:

$$R_4O—[CHR_5—(CHR_6—)—_xO]_y—R_7$$

wherein $R_4$, $R_5$, $R_6$ and $R_7$ are hydrogen or alkyl or araalkyl having 1 to about 10 carbon atoms with the provision that $R_4$ and $R_7$ may not both be hydrogen, x has a value of 3 or 5 and y has a value of 3 or 5 with the proviso that such extraction solvent may contain up to less than 10 percent by weight of an anti-solvent;

(b) forming a solvent phase containing aromatic hydrocarbons and a raffinate phase containing nonaromatic hydrocarbons;

(c) cooling said solvent phase;

(d) introducing said cooled solvent phase to a separation zone and introducing therewith an effective amount of an anti-solvent for said aromatic hydrocarbons in said extraction solvent to provide an extract phase containing aromatic hydrocarbons and a solvent phase containing extraction solvent and anti-solvent;

(e) adjusting the anti-solvent in said solvent phase to less than about 10 percent by weight and recycling said solvent phase to the extraction zone of step (a); and (f) recovering the extract phase of step (d) and the raffinate phase of step (a).

2. The process of claim 1 wherein the extraction solvent is a glycol ether.

3. The process of claim 1 wherein the extraction solvent is hexylene glycol.

4. The process of claim 1 wherein the anti-solvent in step (c) is employed in an amount from about 0.5 to about 25.0 percent by weight.

5. The process of claim 4 wherein the anti-solvent in step (c) is employed in an amount from about 0.5 to about 15.0 percent by weight.

6. The process of claim 1 wherein the anti-solvent is water.

7. The process of claim 1 wherein the temperature in the extraction zone is from about 150° C. to about 275° C.

8. The process of claim 1 wherein the temperature in the separation zone is from about 25° C. to about 150° C.

9. The process of claim 7 wherein the temperature in the extraction zone is from about 170° C. to about 250° C.

10. The process of claim 8 wherein the temperature in the separation zone is from about 25° C. to about 100° C.

11. The process of claim 10 wherein the temperature in the separation zone is from about 25° C. to about 70° C.

12. The process of claim 1 wherein the ratio of solvent to feed in the extraction zone of step (a) is in the range of about 4 to about 12 parts by volume of solvent to one part by volume of feed.

13. The process of claim 1 which includes the additional step of separately contacting the raffinate and extract of step (e) with water to form two water phases containing primarily water and extraction solvent.

14. The process of claim 13 which includes the additional step of recovering the extraction solvent of the water phases and recycling said solvent to step (c).

15. The process for the dearomatization of a mixed hydrocarbon feed comprising a lubricating oil fraction which comprises the following steps: (a) contacting said feed with at a temperature of from about 150° C. to about 275° C. in an extraction zone with an extraction solvent to provide a solvent phase and a raffinate wherein the extraction solvent consists essentially of at least one glycol ether of the formula:

$$R_4O—[CHR_5—(CHR_6—)—_xO]_y—R_7$$

where $R_4$ $R_5$, $R_6$ and $R_7$ are selected from the group consisting of hydrogen, alkyl, aralkyl, alkylaryl and aryl having from 1 to about 10 carbons with the proviso that $R_4$ and $R_7$ are not both hydrogen, "X" is 3 to 5 and y is the integer 3 or 5 with the proviso that up to less than 10 percent by weight water may be present in said extraction solvent;

(b) cooling said solvent phase;

(c) introducing said cooled solvent phase to a separation zone at a temperature between about 10° C. and about 70° C. and having present therewith from about 0.5 and about 25.0 percent by weight water to provide an extract phase containing aromatic hydrocarbons and a solvent-rich phase containing extraction solvent and water;

(d) adjusting the water present in the extraction solvent to less than 10 percent by weight;

(e) recycling the extraction solvent step (d) to step (a);

(f) separately contacting the raffinate of step (a) and the extract of step (c) with water to form two water phases;

(g) combining the water phases of step (f);

(h) recycling at least a portion of the combined water phase of step (g) to step (c); and (i) recovering the extract and raffinate of step (f).

16. The process of claim 1 wherein less than about three percent by weight aromatic hydrocarbon is present in the solvent phase of step (c).

17. The process of claim 15 wherein less than about two percent by weight aromatic hydrocarbon is present in the solvent phase of step (c).

18. The process of claim 16 wherein from about 0.5 to about 15.0 percent of weight water is employed in step (c).

19. The process of claim 17 wherein from about 5.0 to about 10.0 percent by weight water is employed in step (c).

20. The process of claim 15 wherein the temperature in the extraction zone of step (a) is from about 200° C. to about 240° C.

21. The process of claim 15 wherein the temperature in the separation zone is from about 25° C. to about 70° C.

22. The process of claim 15 wherein the ratio of solvent to feed in the extraction zone of step (a) is in the range of about 4 to about 12 parts of weight of solvent to one part by weight of feed.

23. The process of claim 21 wherein the temperature of the extraction zone is from about 200° C. to about 240° C.

24.The process of claim 15 wherein the extraction solvent of step (e) contains an effective amount of water, said effective amount being correlated to the selected feedstock and extraction solvent.

25. The process of claim 24 wherein the amount of water in the extraction solvent is up to about 10 percent by weight.

* * * * *

UNITED STATES PATENT AND TRADEMARK OFFICE

CERTIFICATE OF CORRECTION

PATENT NO. : 4,571,295

DATED : February 18, 1986

INVENTOR(S) : Paulino Forte

It is certified that error appears in the above-identified patent and that said Letters Patent is hereby corrected as shown below:

Col. 1, line 37 "tne" should be -- the --.

Col. 1, line 67 "tne" should be -- the --.

Col. 3, line 55, "hse" should be -- use --.

Col. 3, line 58, "witn" should be -- with --.

Col. 3, line 67, "speaxing" should be -- speaking --.

Col. 4, line 39, "glcol" should be -- glycol --.

Col. 5, line 36, "nonaroamatic" should be -- nonaromatic --.

Col. 5, line 55, "reffinate" should be --raffinate --.

Col. 6, line 23, "wnich" should be -- which --.

UNITED STATES PATENT AND TRADEMARK OFFICE

CERTIFICATE OF CORRECTION

PATENT NO. : 4,571,295

DATED : February 18, 1986

INVENTOR(S) : Paulino Forte

It is certified that error appears in the above-identified patent and that said Letters Patent is hereby corrected as shown below:

Col. 10, line 11 "dectector" should be -- detector --.

Col. 10, line 40, "A" should be -- An --.

Col. 10, line 48, "Tne" should be -- The --.

Col. 10, line 63, "ricn" should be -- rich --.

Col. 11, line 44, "extrained" should be -- entrained --.

Col. 11, line 48, "througn" should be -- through --.

Col. 13, line 29, "(lean solvent)phase" should be -- (lean solvent))phase. --.

Col. 14, line 14, "araalkyl" should be -- aralkyl --.

Col. 15, line 19, "R4 R5, R6" should be -- R4, R5, R6 --.

Signed and Sealed this

*Fifth* Day of *August 1986*

[SEAL]

*Attest:*

DONALD J. QUIGG

*Attesting Officer*

*Commissioner of Patents and Trademarks*